United States Patent [19]

Easom et al.

[11] Patent Number: 5,072,677

[45] Date of Patent: Dec. 17, 1991

[54] ENCLOSING ELASTIC IN A FABRIC

[75] Inventors: Peter W. Easom, Melton Mowbray; Stephen P. Bridle, West Bridgford, both of United Kingdom

[73] Assignee: Automatic Braiding Limited, Melton Mowbray, United Kingdom

[21] Appl. No.: 614,146

[22] Filed: Nov. 15, 1990

[51] Int. Cl.[5] ..... D05B 23/00

[52] U.S. Cl. ..... 112/121.27; 112/152; 112/305

[58] Field of Search ..... 112/121.27, 152, 121.26, 112/139, 305, 141, 142; 493/439, 136, 137, 147, 262.3, 121.19

[56] References Cited

U.S. PATENT DOCUMENTS

| | | | |
|---|---|---|---|
| 3,515,081 | 6/1970 | Miller | 112/121.27 X |
| 3,525,310 | 8/1970 | Gensheimer | 112/142 |
| 4,722,289 | 2/1988 | Ohsawa | 112/152 X |
| 4,739,718 | 4/1988 | Effinger et al. | 112/121.27 X |

FOREIGN PATENT DOCUMENTS

| | | | |
|---|---|---|---|
| 2461684 | 7/1975 | Fed. Rep. of Germany | 112/121.27 |
| 1406822 | 9/1975 | United Kingdom . | |
| 1445391 | 8/1976 | United Kingdom . | |

*Primary Examiner*—Werner H. Schroeder
*Assistant Examiner*—Paul C. Lewis
*Attorney, Agent, or Firm*—Poms, Smith, Lande & Rose

[57] ABSTRACT

Apparatus for securing an elastic band in a hem tunnel formed of garment fabric comprises a fabric folding device having an entry zone and an exit zone both of which are planar, the entry zone being inclined at an angle, conveniently between 30° and 90°, preferably 45°, relative to the exit zone. A guide roller by which a band is guided to the entry zone is rotatable about an axis parallel with the entry zone and at right angles to the direction of feed of the band and fabric through the device. The apparatus facilitates the incorporation of draw-cord elastic into garment hem tunnels.

13 Claims, 2 Drawing Sheets

ENCLOSING ELASTIC IN A FABRIC

FIELD OF THE INVENTION

This invention relates to enclosing of elastic in a fabric and especially to apparatus suitable for use in enclosing and securing an extensible elastic band within a hem tunnel formed in a length of garment fabric.

BACKGROUND TO THE INVENTION

Many garments have an extensible wearer-encircling portion such garments include for example track suits, casual jackets, ladies and means leisure trousers and the like. The wearer-encircling portion may be for example a waist band, a cuff band or an ankle band.

In our Pat. No. GB 1406822 is described a method of securing and enclosing an extensible elastic band within a hem tunnel formed in a length of garment fabric and apparatus for securing and enclosing an extensible elastic band within a hem tunnel formed in the length of garment fabric. Apparatus generally similar to that described in our Patent. Specification has been used successfully for enclosing an elastic band in a hem tunnel formed in a length of garment fabric in a wide variety of applications. One form of elastic band which is desirably included in some garments, for example the waist band of certain leisure trousers is commonly referred to as draw-cord elastic. Draw-cord elastic comprises a substantially inextensible cord extending lengthwise along a region of the elastic band. In use in a garment portions of the draw-cord ar appropriate positions are accessible to a wearer thus to draw the wearer-encircling portion of the garment tighter and secure it in the tightened position, for example by tying a suitable knot. Draw-cord elastic is produced by the applicant company and a draw-cord elastic is the subject of our Pat. No. GB 1406821.

Apparatus described in our Pat. No. GB 1406822 comprises a folding device and the apparatus supplied by the applicant company has utilized a folding device which is about 16 cms in length and which comprises two parallel members through a gap in which the band and fabric travel in face contact, the members in the commercially supplied device, as in the device as described by way of example in our Pat. No. 1406822 twisting in their length through 180°. Apparatus with a folding device of this length has been found suitable for use in enclosing many elastic bands within a hem tunnel but not altogether satisfactory for enclosing an elastic band including a draw-cord which has been found to show a tendency to collapse along the centre line: this has apparently occurred because of the degree of twist applied to the elastic band in a relatively short distance.

In order to satisfactorily enclose a draw-cord elastic within a hem tunnel using apparatus generally as shown in our Pat. No. 1406822, a longer folding device has been found to be necessary having a length of about 30 cms and again the folding members twisting in their length through 180°. The severity of the twist applied to the elastic band in such a longer machine is much reduced and with such a machine having a longer folding device the tendency of the band including draw-cord to collapse along its centre line has been substantially reduced so that it is virtually non-existent.

The use of a longer folding device, however, is itself not altogether satisfactory (although the results obtained using draw-cord elastic are much improved) because the operator of the succeeding sewing machine to which the work is fed is necessarily further from the sewing machine making control of the sewing more difficult and thus being less ergonomically satisfactory. Furthermore, the longer folding device is necessarily more expensive. As far as production is concerned, the short system is easier and faster to use, thereby increasing productivity whereas the longer folding device leads to more scrap and greater wastage of elastic.

OBJECTS OF THE INVENTION

One of the various objects of the present invention is to provide improved apparatus suitable for use in securing and enclosing an extensible elastic band within a hem tunnel formed in a length of garment fabric and especially such apparatus suitable for use in securing an extensible elastic band including a draw-cord.

SUMMARY OF THE INVENTION

In one aspect the invention may be considered to provide apparatus suitable for use in securing and enclosing an extensible elastic band within a hem tunnel formed in a length of garment fabric comprising a fabric folding device for forming fabric into a hem tunnel, for example by folding a marginal strip of fabric protruding beyond an edge of an elastic band fed to the folding device with a first face of the band in contact with a first face of the fabric around said edge of the band to overlay a second, opposite face of the band and by folding the fabric about the other edge of the band to present said second face of the band, and the marginal strip, to the first face of the fabric whereby to present the fabric folded about the band on a substantially planar path to a mechanism for withdrawing the band and fabric from a planar or substantially planar exit zone of the folding device and for securing the band in the hem tunnel, the fabric folding device comprising a substantially planar entry zone at which the fabric and band are introduced into the folding device inclined at an angle relative to said exit zone, and the apparatus further comprising a guide roll by which a band is guided to said folding device, mounted for rotation about an axis parallel or substantially parallel with the plane of the entry zone but at right angles or substantially at right angles to the direction of feed of material through the folding device.

In another aspect the invention may be considered to provide an attachment for a machine suitable for use in securing and enclosing an extensible elastic band in a hem tunnel formed in a length of garment fabric comprising a fabric folding device having a planar or substantially planar entry zone at which an elastic band and fabric to be folded thereabout can be introduced to the folding device and a planar or substantially planar exit zone from which the band with fabric folded thereabout can be presented to mechanism of a machine for securing the band within the hem tunnel, wherein the entry zone is inclined at an angle relative to the exit zone, the attachment further comprising a guide roller by which a band can be guided to the entry zone the guide roller being mounted for rotation about an axis parallel or substantially parallel with the entry zone and at right angles to the direction in which the band and fabric passes through the device in the use thereof.

Preferably, in accordance with the invention, the axis of the guide roller and the entry zone are inclined at and angle of between 30° and 90°, more preferably about 45° to the exit zone. Although an angle of about 45° is preferred, it may be possible to position the guide roller and the entry zone of the folding device perpendicular to the exit zone of the folding device; for example, in a normal sewing machine the exit zone would be horizontal and the axis of the guide roller and the entry zone vertical. In this instance, the fabric may be supplied to the entry zone of the folding device through an L-shaped guide with the bulk of the fabric above the guide roll and the portion to be folded about the elastic band depending downwardly.

Preferably the folding device defines the entry and exit zones. Suitably the folding device comprises two parallel members which define the entry and exit zones, and portions of the band and fabric travel between the members. Preferably a first of the members has a width equal to or greater than that of the band and the second of the members is narrower and located adjacent one edge portion of the first member. The members twist in their length through an angle of less than 180° (the angle depending upon the angle of the entry zone relative to that of the exit zone). By reducing the angle by which the members twist in their lengths, it is possible to reduce the twisting force applied to the band by a folding device of a given length, and the tendency of a band including a draw-cord to collapse is thereby reduced.

Apparatus in accordance with the invention preferably comprises a pair of metering rollers, at least one of which is driven, for forwarding the band at a predetermined linear speed to the guide roller. The mechanism for withdrawing the band and fabric from the folding device preferably comprises a pair of rollers so driven that the band and fabric are withdrawn from the folding device in the operation of the apparatus at a greater linear speed than that at which the band is forwarded by the metering rollers.

The mechanism for drawing the band and fabric from the folding device and for securing the band in the hem tunnel in apparatus in accordance with the invention is preferably a sewing mechanism of known construction but other means of securing the band may be employed if desired, for example a heat seal adhesive material activated by the securing mechanism.

Whereas apparatus in accordance with the invention may be integrally constructed to include a guide roller and folding device, conveniently the folding device and guide roller are included in an attachment e.g. for a sewing machine so that the attachment can be readily exchanged to deal with various different materials. An attachment in accordance with the invention may be secured to existing sewing machines in replacement for attachments including a longer folding device as used presently.

In order that the currently available sewing machines may readily be used to enclose elastic with or without draw-cords in the most efficient manner, the sewing machines have been constructed with a readily detachable attachment carrying inter alia the folding device so that the attachment can readily be removed and replaced by an attachment appropriately to the work to be carried out.

DESCRIPTION OF PREFERRED EMBODIMENTS

Figure 1:
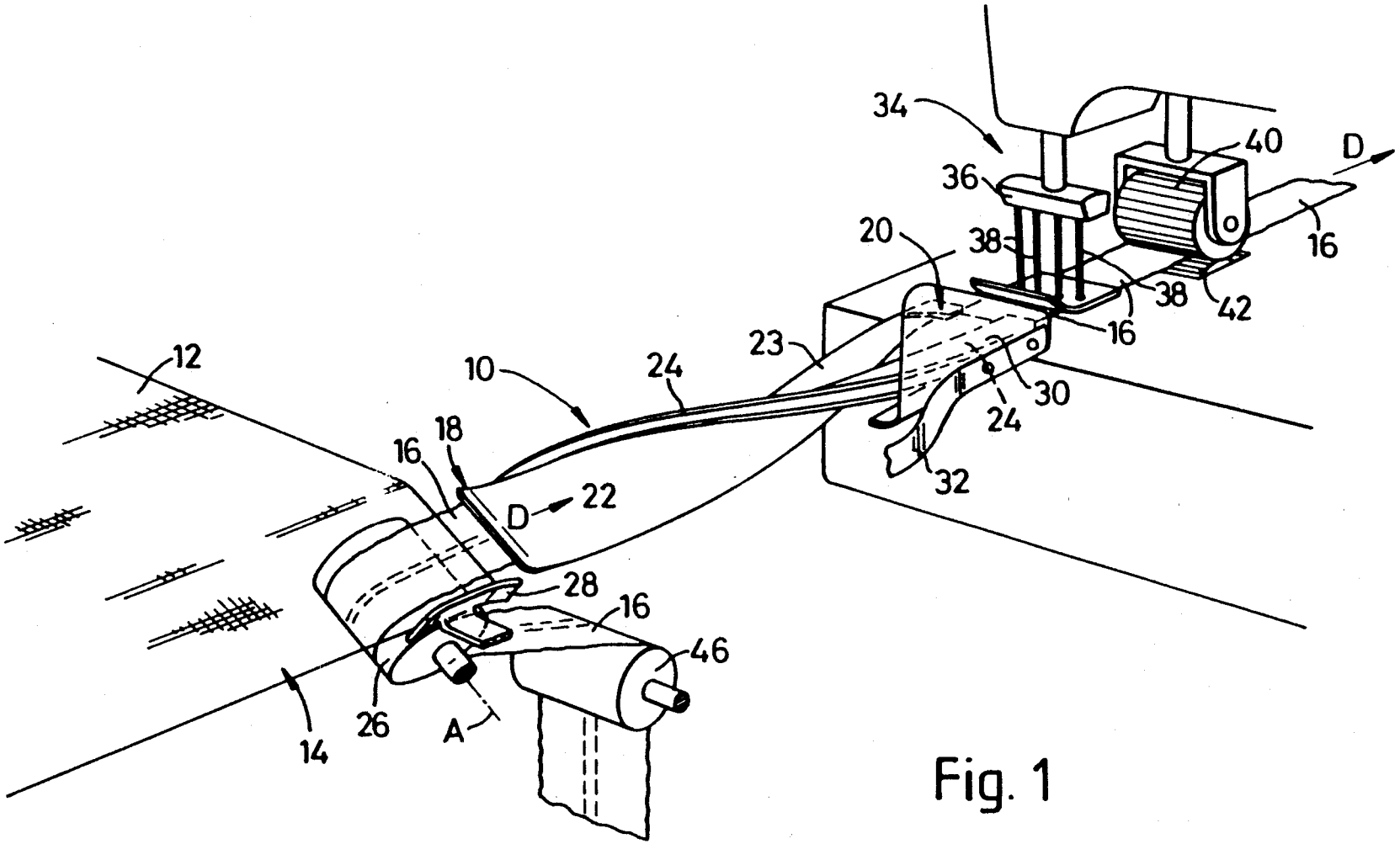
FIG. 1 is a schematic perspective view showing apparatus embodying the invention with parts broken away.

The illustrative apparatus functions in a manner which is well known to those skilled in the art to wrap a part of the garment fabric around an elastic band to form a hem tunnel and to secure the elastic band within the hem tunnel utilising a sewing machine. The method is generally as described in our Pat. No. GB 1406822.

The illustrative apparatus comprises a folding device 10 for forming fabric 12 into a hem tunnel by folding a marginal strip 14 of fabric protruding beyond an edge of an elastic band 16 fed to the folding device 10, with a first face of the band in contact with the first face of the fabric 12 around said edge of the band to overlay a second, opposite, face of the band 16 and by folding the fabric about the other edge of the band 16 to present a second face of the band and marginal strip 14 to the first face of the fabric.

The folding device 10 comprises an entry zone 18 and an exit zone 20 both of which are substantially planar. The folding device 10 comprises two parallel members 22, 24 between which portions of the band and fabric travel along the folding device 10. A first of the members 22 has a width substantially equal to that of the band 16 and a turned over marginal portion 23 for folding the strip 14 round the edge of the band. The second of the members 24 is much narrower than the member 22 and located adjacent one edge portion of the first member 22. The members twist in their length through an angle of less than 180°.

The apparatus further comprises a first guide roller 26 by which the band 16 is guided to the folding device 10. The guide roller 26 is mounted for rotation about an axis A which is parallel with the plane F of the entry zone of the folding device 10 but at right angles with the direction D of feed of material through the folding device 10. A guide 28 is positioned adjacent the guide roller 26 against which an edge portion of the fabric 12 may be guided when feeding the fabric 12 into the folding device 10. A retaining member 30 is mounted on spring means conveniently a leaf spring 32 to aid in retaining the folded fabric in position as it leaves the folding device 10; the spring mounting of the member 30 permits it to yield thus to allow bulky seams to pass unrestricted, the spring 32 returning the member 30 to its normal position.

Folding device 10, the retaining device 30 and the guide roller 26 are all mounted on an attachment which is readily removable from a sewing machine 34 adapted to secure the band in the hem tunnel.

Existing machines supplied by Automatic Braiding Limited include attachments mounting inter alia long or short folding devices as outlined above, the members of which twist through 180° in the length of the device. The attachments of the existing machines are commonly inter-changed dependant on whether or not the elastic to be incorporated in the hem tunnel is a draw-cord elastic. The attachment of the illustrative machine is constructed to likewise be readily exchangeable with the existing attachments.

As can be seen from the drawings, the sewing machine comprises a needle bar 36 carrying needles 38. The sewing machine further comprises a pair of feed rollers 40, 42, being so driven that the band and fabric, passing between the rollers are withdrawn from the folding device in known manner.

The illustrative sewing machine further comprises a metering device, viz pair of metering rollers (not shown), at least one of which is driven, for forwarding the band at a predetermined linear speed over an idler roller 46 to the guide roller 26. The metering rollers are of known construction. The idler roller 46 is also carried on the attachment for the sewing machine, as is the guide roller 26; however the metering device is carried on the frame of the sewing machine and is utilized with other attachments carrying folding devices which may be mounted on the sewing machine. In known manner, the feed of the material by the feed rollers 40, 42 is co-ordinated with the reciprocation of the needle bar 36 and movement of the feed dog (positioned beneath the foot of the sewing machine) and the feed rollers 40, 42 and feed dog are driven at such a speed that the band and fabric are withdrawn from the folding device 10 at a greater linear speed than that at which the band 16 is forwarded by the metering rollers so that the band 16 is in a tensioned condition as it is secured within the hem tunnel.

In the drawings, the band 16 is shown extending through the machine; however, a piece of garment fabric 12 is shown in a position where it is about to enter the entry zone of the folding device.

Figure 2:
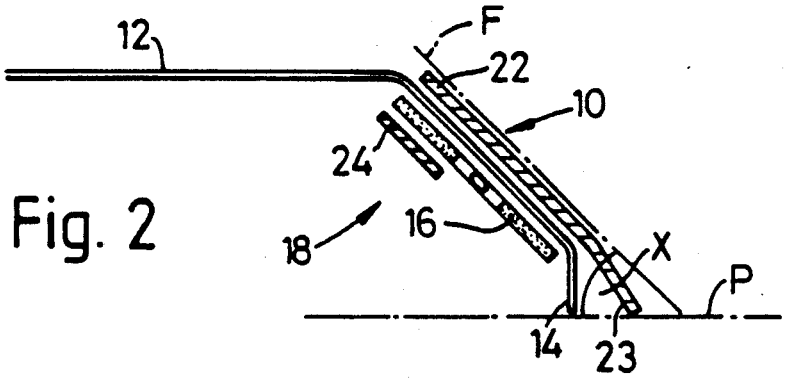
FIGS. 2 to 5 are diagrammatic views in section through a fabric folding device of the illustrative apparatus showing successive stages of folding as the fabric and band pass through the folding device from the region of an entry zone (shown in FIG. 2 to an exit zone shown in FIG. 5).
Figure 3:
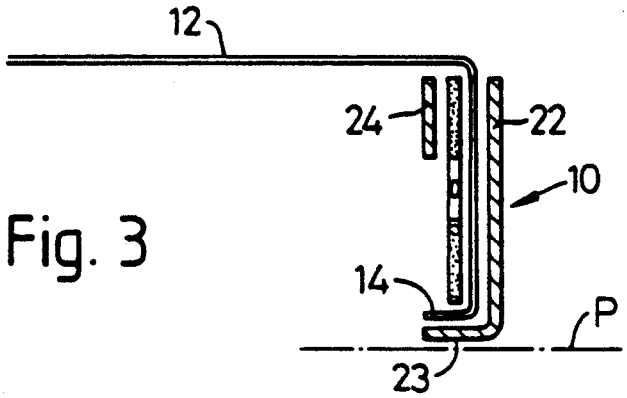
Figure 4:
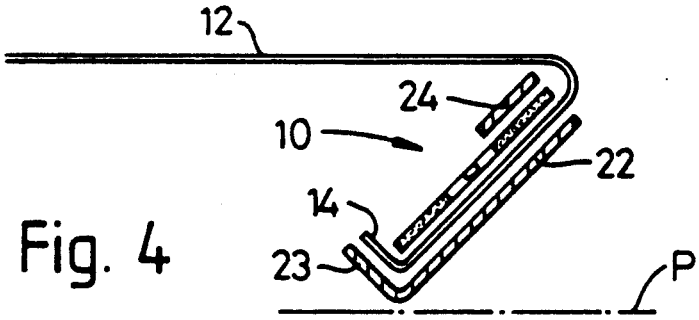
Figure 5:
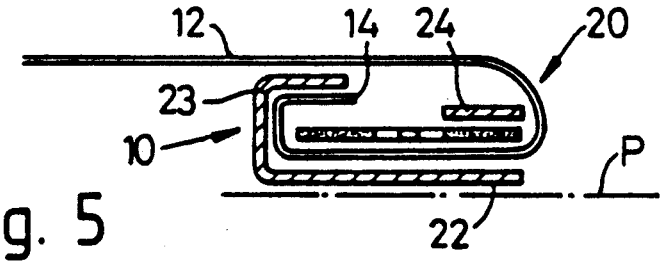

FIGS. 2 to 5 show the folding device 10 at various positions along its length. FIG. 2 is a view at the entry zone 18 while FIG. 5 is a view at the exit zone 20. The exit zone 20 is substantially planar and horizontal, as indicated by the chain dot line P which is also parallel with the planar path of the material leaving the folding device 10. The plane P is shown on each of FIGS. 2 to 5. In FIG. 2 the plane of the entry zone 18 is indicated by the chain dot line F and as can be seen from FIG. 2 this is inclined at an angle X to the plane of the exit zone P. The axis A of the guide roller 26 is parallel with the plane F. In the apparatus the angle X is about 45° but this may be varied in other apparatus in accordance with the invention, generally similar to the illustrative apparatus, as desired.

As the length of the folding device 10 is about 16 cms, corresponding with the length of the short folding devices of the known machines supplied by the applicant company, whilst the angle through which the member 22 twists along the length of the folding device is only about 135°, the severity of the twisting force applied to the band 16 is less than would be the case were the standard folding device to be used and the tendency of drawcord elastic to collapse is substantially eliminated. The illustrative apparatus is easier for an operator to use when inserting draw-cord elastic than the existing apparatus utilising a longer folding device and can be run at a faster speed due to the reduced resistance. Furthermore, the illustrative attachment is less expensive than the known attachments for dealing with draw-cord elastic satisfactorily and a reduction in scrap can also arise.

What is claimed is:

1. Apparatus suitable for use in securing and enclosing an extensible elastic band within a hem tunnel formed in a length of garment fabric comprising a fabric folding device for forming fabric into said hem tunnel to present the fabric automatically folded about said band on a substantially planar path to a mechanism for withdrawing said band and fabric from a substantially planar exit zone of the folding device and for securing said band in said hem tunnel, wherein the fabric folding device comprises a substantially planar entry zone inclined at an angle relative to said exit zone wherein said fabric and said band are introduced into the folding device in a direction of feed therethrough, and wherein the apparatus further comprises a guide roll wherein said band is guided to said folding device, mounted for rotation about an axis substantially parallel with the plane of the entry zone but at substantially a right angle to said direction of feed of said fabric through the folding device.

2. Apparatus according to claim 1 wherein said entry zone and said axis are in lined at an angle of between 30° and 90 ° to said exit zone.

3. Apparatus according to claim 1 wherein said entry zone and said axis are inclined at an angle of about 45° to said exit zone.

4. Apparatus according to claim 1 wherein the folding device comprises two elongated parallel members each having a longitudinal axis wherein portions of the band and fabric travel between the members, the members twisting about their longitudinal axes through an angle of less than 180° and one of the members having a turned over marginal portion for folding a marginal strip of the fabric round the edge of the band.

5. Apparatus according to claim 4 wherein a first of said members has a width substantially equal to that of the band and the second of said members is narrower and located adjacent one edge potion of said first member.

6. Apparatus according to claim 1 comprising a pair of metering rollers, at least one of which is driven, for forwarding the band at a predetermined linear speed to the guide roller.

7. Apparatus according to claim 6 wherein said mechanism for withdrawing the band and fabric from the folding device comprises a pair of rollers coupled to said band and fabric.

8. An attachment for a machine suitable for use in securing and enclosing an extensible elastic band in a hem tunnel formed in a length of garment fabric comprising an automatic fabric folding device having a substantially planar entry zone at which said elastic band and said fabric to be automatically folded thereabout can be introduced in a direction through said folding device and a substantially planar exit zone from which said band with said fabric folded thereabout can be presented to mechanism of a machine for securing said band within the hem tunnel, wherein the entry zone is inclined at an angle relative to the exit zone, the attachment further comprising a guide roller by which said band can be guided to the entry zone in said direction therethrough, the guide roller being mounted for rotation about an axis substantially parallel with the entry zone and at substantially right angles to said direction in which the and and fabric pases through the device in the use thereof.

9. An attachment according to claim 8 comprising at least one elongated member having a longitudinal axis having an operative surface of width substantially equal to that of the band to be enclosed which twists about its longitudinal axis from theory zone to the exit zone through an angle of less than 180°.

10. An attachment according o claim 9 wherein said angle is less than 150°.

11. Apparatus suitable for use in securing and enclosing an extensible elastic band within a hem tunnel formed in a length of garment fabric comprising a fabric folding device for forming fabric into said hem tunnel to present the fabric folded about said band on a substantially planar path to a mechanism for withdrawing said band and fabric from a substantially planar exit zone of the folding device and for securing said band in said hem tunnel, wherein the fabric folding device comprises a substantially planar entry zone inclined at an angel relative to said exist zone wherein said fabric and said band are introduced into the folding device in a direction of feed therethrough, and wherein the apparatus further comprises a guide roll wherein said band is guided to said folding device, mounted for rotation about an axis substantially parallel with the plane of the entry zone but at substantially a right angle to said direction of feed of aid fabric through the folding device, said folding device comprising two elongated parallel members each having a longitudinal axis wherein portions of the band and fabric travel between the members, the members twisting about their longitudinal axis through an angle of less than 180° and one of the members having a turned over marginal portion for folding a marginal strip of the fabric round the edge of the band.

12. An attachment for a machine suitable for use in securing and enclosing an extensible elastic band in a hem tunnel formed in a length of garment fabric comprising a fabric folding device having a substantially planar entry zone at which said elastic band and said fabric to be folded thereabout can be introduced in a direction through said folding device and a substantially planar exit zone from which said band with said folded thereabout can be presented to mechanism of a machine for securing said band within the them tunnel, wherein the entry zone is inclined at ana angle relative to the exit zone, the attachment further comprising a guide roller by which said band can be guided to the entry zone in said direction therethrough, the guide roller being mounted for rotation about an axis substantially parallel with the entry zone and at right angles to said friction in which the and and fabric passes through the device in the use thereof, and at least one elongated member having a longitudinal axis having an operative surface of width substantially equal to that of the band to be enclosed which twists about the longitudinal axis from the entry zone to the exit zone through an angle of less than 180°.

13. An attachment according to claim 12 wherein said angle is less than 150°.

* * * * *